US007050003B2

(12) United States Patent
Sievenpiper

(10) Patent No.: US 7,050,003 B2
(45) Date of Patent: May 23, 2006

(54) LOW-PROFILE ANTENNA

(75) Inventor: Daniel F. Sievenpiper, Los Angeles, CA (US)

(73) Assignee: General Motors Corporation, Detroit, MI (US)

( * ) Notice: Subject to any disclaimer, the term of this patent is extended or adjusted under 35 U.S.C. 154(b) by 0 days.

(21) Appl. No.: 10/408,004

(22) Filed: Apr. 4, 2003

(65) Prior Publication Data

US 2004/0196200 A1 Oct. 7, 2004

(51) Int. Cl.
*H01Q 1/38* (2006.01)

(52) U.S. Cl. ..... 343/700 MS; 304/702

(58) Field of Classification Search ..... 343/700 MS, 343/702, 771, 749, 795, 728, 846, 830
See application file for complete search history.

(56) References Cited

U.S. PATENT DOCUMENTS 5,652,595 A 7/1997 Ahrens et al. ..... 343/700 MS
5,784,032 A 7/1998 Johnston et al. ..... 343/702
5,864,318 A * 1/1999 Cosenza et al. ..... 343/700 MS
6,014,105 A 1/2000 Davis et al. ..... 343/700 MS
6,064,347 A * 5/2000 Fordham ..... 343/749
6,072,434 A * 6/2000 Papatheodorou ..... 343/700 MS
6,166,701 A * 12/2000 Park et al. ..... 343/771
6,252,553 B1 * 6/2001 Solomon ..... 343/700 MS
6,326,921 B1 * 12/2001 Egorov et al. ..... 343/700 MS
6,356,242 B1 * 3/2002 Ploussios ..... 343/795
6,718,619 B1 * 4/2004 Lebaric et al. ..... 29/600

OTHER PUBLICATIONS

Deshpande et al, "Analysis of Reactively Loaded Microstrip Disk Antenna," *IEEE Proceedings*, vol. 136, Pt. H, No. 5, Oct. 1989, pp. 417-419.

* cited by examiner

*Primary Examiner*—Tuyet Vo
*Assistant Examiner*—Huedung X. Cao
(74) *Attorney, Agent, or Firm*—Laura C. Hargitt

(57) ABSTRACT

A low-profile antenna includes a metal plate having a feed tab and support tabs. The feed tab and support tabs are folded to create slots. The feed tab and support tabs contact a ground plane. The support tabs perform impedance matching. The ground plane includes a printed circuit board with a top metal layer, a bottom metal layer, and a dielectric middle layer. A feed hole and support holes are formed in the printed circuit board and align with the feed tab and support tabs. The antenna produces a radiation pattern that is substantially omnidirectional in an azimuth direction and substantially null in a zenith direction.

34 Claims, 5 Drawing Sheets

LOW-PROFILE ANTENNA

FIELD OF THE INVENTION

The present invention relates to low-profile antennas, and more particularly to low-profile antennas for vehicular applications.

BACKGROUND OF THE INVENTION

Low-profile antennas are commonly used in vehicles. The antennas are typically mounted on an exterior of the vehicle. For aesthetic reasons, the antennas are preferably small in size. The vehicle may have several antennas in one antenna assembly or network.

Several conventional low-profile antennas include multiple parts. Since large volumes are produced, reducing the number of parts used to manufacture the antenna can significantly reduce the cost. For terrestrial applications, the antenna should maximize transmit/receive signals in lateral directions while minimizing signals in a vertical direction.

U.S. Pat. No. 5,652,595 to Ahrens et al. describes a patch antenna having reactive loading. The patch antenna includes several different layers and materials, which are costly to manufacture. U.S. Pat. No. 5,784,032 to Johnston et al. describes a planar antenna having several shorting tabs. However, the planar antenna does not allow high capacitive loading. Increased capacitive loading allows the antenna to be made with a lower profile for a given frequency of operation. U.S. Pat. No. 6,014,105 to Davis et al. describes a microstrip antenna that includes multiple parts and has a relatively high manufacturing cost. The microstrip antenna feed is located off-center, which reduces efficiency for terrestrial reception. An article by M. Deshpandea and Y. Rao, "Analysis of Reactively Loaded Microstrip Disk Antenna", in *IEEE Proceedings*, Vol. 136, No. 5, describes a patch type antenna having a tab extending from a body of the patch. However, the tab produces circular polarization and is not used for impedance matching. A traditional feed is still needed for the patch antenna.

A common way of making these antennas involves using two metal pieces. A first metal piece forms a top plate. A second metal piece provides shorting pins. The metal pins are typically bent out of the plate to reveal slots. Ordinarily, the slots would form part of the antenna design, to make the antenna smaller or more broad-band, or the slots would be designed out. When the first and second metal pieces are soldered together, the slots are typically eliminated.

SUMMARY OF THE INVENTION

A low-profile antenna according to the present invention includes a metal plate. A feed tab is formed near a center point of the metal plate. The antenna includes a ground plane. The feed tab is folded and creates a slot in the metal plate. The feed tab contacts the ground plane.

In other features, the metal plate has mirror symmetry in at least four planes that intersect at the center point of the metal plate. The antenna has mirror symmetry in at least two planes that intersect at the center point when the feed tab is formed in the metal plate.

In still other features of the invention, first and second support tabs are formed in the metal plate. The first and second support tabs are folded and create second and third slots in the metal plate. The first and second support tabs contact the ground plane. The first and second support tabs are oriented radially with respect to the center point of the metal plate. The first and second support tabs are located symmetrically with respect to the center point of the metal plate. The feed tab, first support tab, and second support tab include a flange for aligning the metal plate with the ground plane. The first and second support tabs perform impedance matching.

In yet other features, the ground plane is a printed circuit board and includes a top metal layer, a bottom metal layer, and a dielectric material layer between the top metal layer and the bottom metal layer. A feed hole is formed in the printed circuit board and aligns with the center point of the metal plate. A circular insulating region is formed in the top metal layer and surrounds the feed hole. An isolated metal region of the top metal layer is left within the circular insulating region. A first metal via is plated inside the feed hole and connects the isolated metal region to a feed circuit on a bottom side of the printed circuit board. First and second support holes are formed in the printed circuit board. Second and third metal vias are plated inside the first and second support holes. First and second circular metal regions surround the first and second support holes on the bottom side of the printed circuit board.

In still other features of the invention, the low-profile antenna is mounted vertically on the exterior of a vehicle. The low-profile antenna is part of a multi-antenna module. The low-profile antenna produces a radiation pattern that is substantially omnidirectional in an azimuth direction and substantially null in a zenith direction. The metal plate includes tin plated brass. The low-profile antenna operates in the Personal Communications Services (PCS) frequency band.

Further areas of applicability of the present invention will become apparent from the detailed description provided hereinafter. It should be understood that the detailed description and specific examples, while indicating the preferred embodiment of the invention, are intended for purposes of illustration only and are not intended to limit the scope of the invention.

BRIEF DESCRIPTION OF THE DRAWINGS

The present invention will become more fully understood from the detailed description and the accompanying drawings, wherein.

DETAILED DESCRIPTION OF THE PREFERRED EMBODIMENTS

Figure 1:
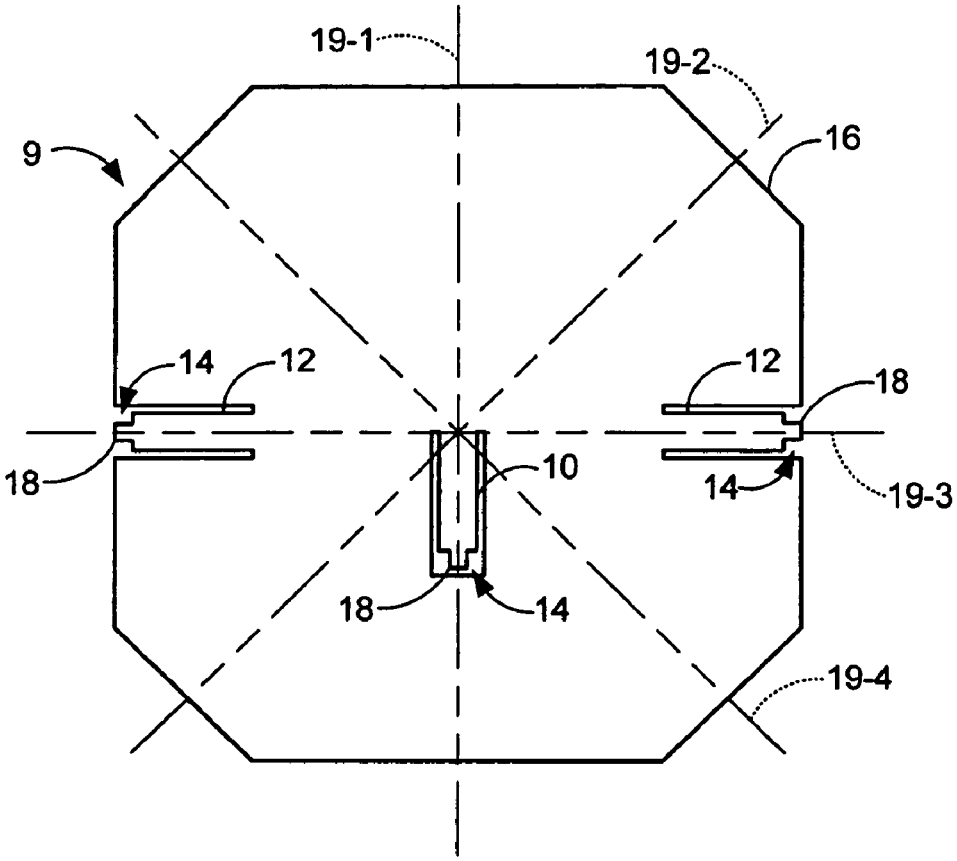
FIG. 1 is a plan view of a metal plate with a feed tab and two support tabs without the tabs bent.

The following description of the preferred embodiment(s) is merely exemplary in nature and is in no way intended to limit the invention, its application, or uses. For purposes of clarity, the same reference numbers will be used in the drawings to identify similar elements.

Figure 2:
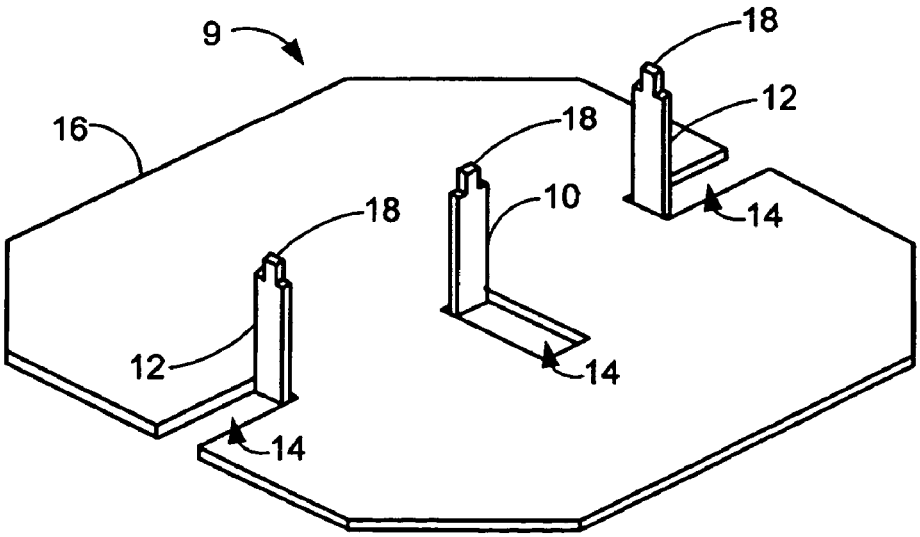
FIG. 2 is an isometric view of the metal plate with the tabs bent.
Figure 3:
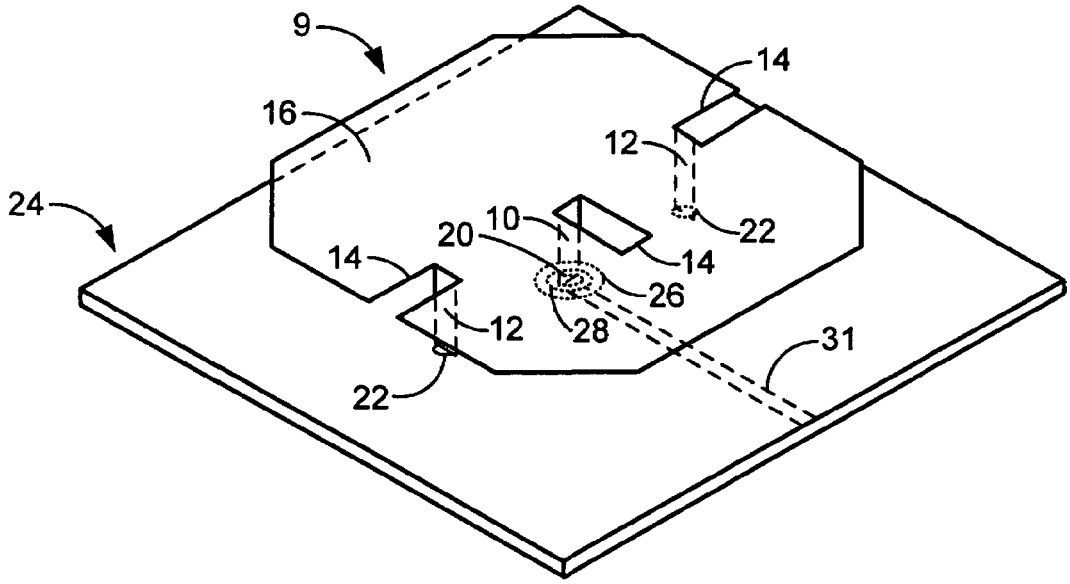
FIG. 3 is an isometric view of the metal plate and a ground plane.
Figure 4:
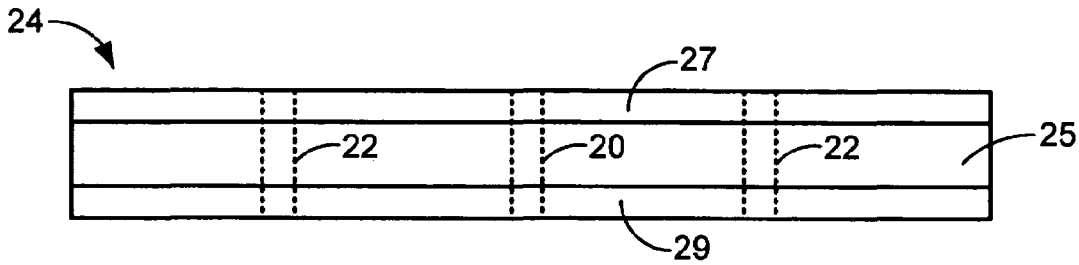
FIG. 4 is a sectional view of a ground plane formed as a printed circuit board.
Figure 5:
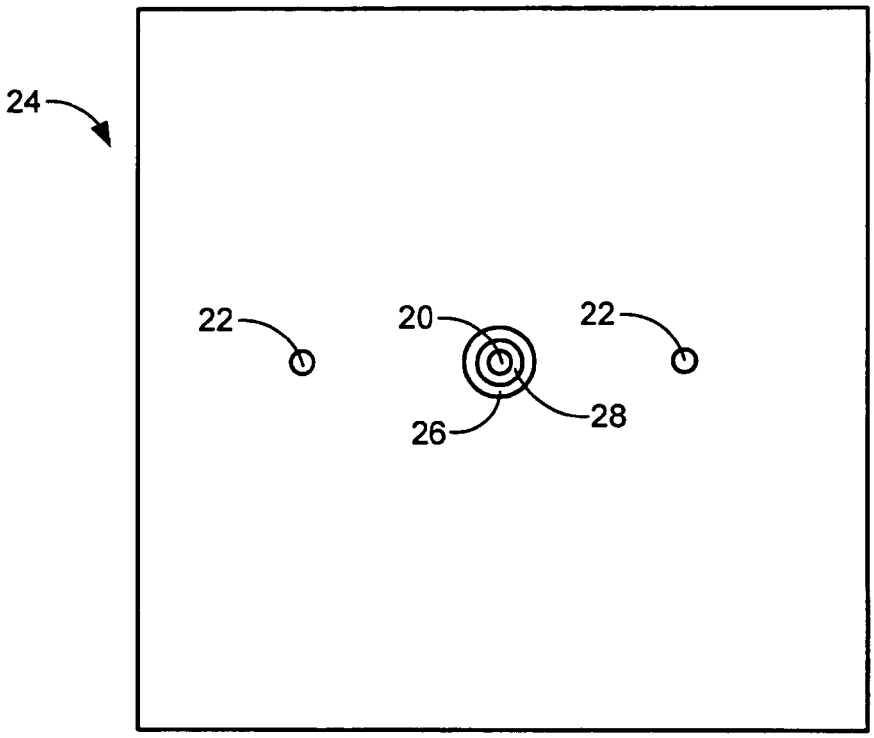
FIG. 5 is a plan view of the top side of the ground plane.
Figure 6:
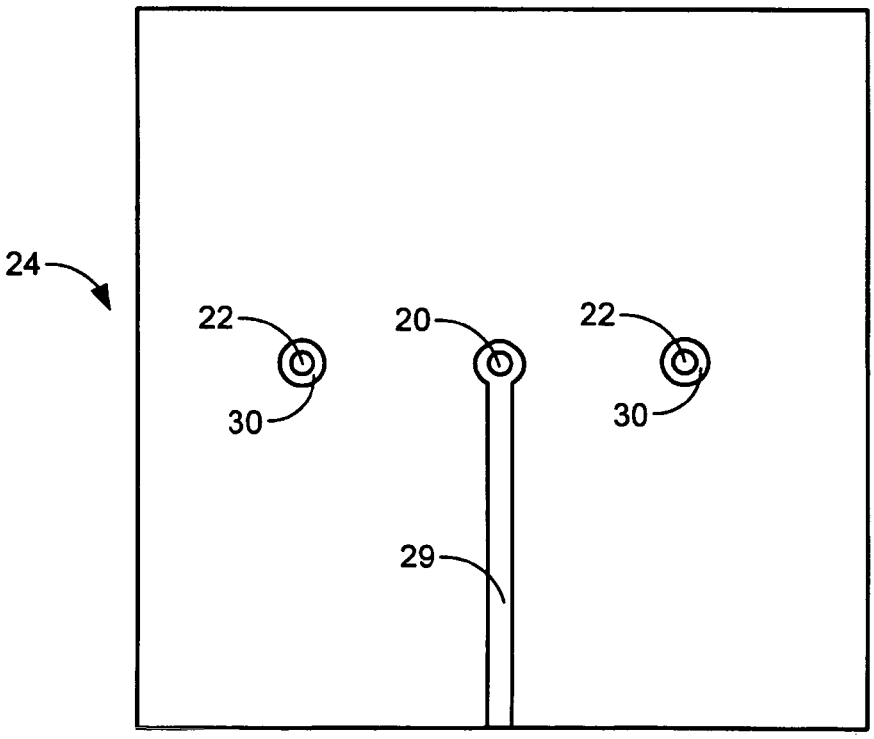
FIG. 6 is a plan view of the bottom side of the ground plane.

Referring now to FIGS. 1 and 2, an antenna 9 is produced when a feed tab 10 and support tabs 12 are formed in slots 14 of a metal plate 16. The slots 14 remain when the feed tab 10 and support tabs 12 are folded. For example, the feed tab 10 and support tabs 12 can be folded approximately ninety degrees relative to a plane containing the metal plate 16. The feed tab 10 and support tabs 12 extend from the metal plate 16 to contact a ground plane (not shown in FIG. 1 or 2). The metal plate 16 is formed of a solid piece of metal. The feed tab 10 and the support tabs 12 include a flange 18 that aligns with the ground plane.

While three support tabs 12 are shown, those skilled in the art can appreciate that other numbers or combinations of support tabs 12 can be used. While zero or one support tab can be used, preferably two or more support tabs 12 are used in addition to the feed tab 10 to improve performance. Using at least two support tabs 12 improves impedance matching. Additionally, the feed tab 10 and support tabs 12 can be folded at angles other than ninety degrees.

The feed tab 10 is located at, near, or adjacent to the center of the metal plate 16. In an exemplary embodiment, the support tabs 12 are located symmetrically about the feed tab 10. Without the feed tab 10 and support tabs 12, the metal plate 16 has mirror symmetry in four planes (identified by 19) intersecting at the center point (due to its octagonal shape). The antenna 9 has mirror symmetry in at least two planes that intersect at the center point when just the feed tab 10 is formed in the metal plate 16. When both the feed tab 10 and support tabs 12 are formed in the metal plate, the degree of symmetry of the antenna 9 is determined by the placement of the feed tab 10 and support tabs 12.

A metal plate with one feed tab and two support tabs can achieve mirror symmetry in one plane, and preferably two planes. A metal plate with one feed tab and three support tabs can achieve threefold rotational symmetry. A metal plate with one feed tab and four support tabs can achieve both fourfold rotational symmetry and mirror symmetry in two orthogonal planes. In each of these cases, only the shape of the metal plate and the location of the support tabs is considered. The effect that the slots have on the performance of the antenna is not considered. In an exemplary embodiment of the invention, the feed tab 10 and support tabs 12 are oriented radially with respect to the center of the metal plate 16.

Referring now to FIGS. 3–6, an exemplary antenna arrangement is shown and includes two parts. A first part is the metal plate 16 having a feed tab 10 that is folded and support tabs 12 that are folded. A second part is a ground plane 24, which can be implemented as a metal sheet. The ground plane 24 is preferably formed as a printed circuit board because of the common need for additional circuit components such as amplifiers.

If implemented as a printed circuit board, the ground plane 24 includes a dielectric layer 25 located between a top metal layer 27 and a bottom metal layer 29. Other combinations of metal and dielectric layers are also possible. The top metal layer 27 is located closest to the metal plate 16 and includes a feed hole 20 for the feed tab 10 and support holes 22 for the support tabs 12.

The feed tab 10 is associated with the feed hole 20 that includes a circular insulating region 26 surrounding an isolated metal region 28. The isolated metal region 28 is connected to a plated metal via inside the feed hole 20. The feed hole 20 is also connected to a feed circuit 31 on the other side of the board. The feed circuit 31 is preferably a microstrip line. The support holes 22, which are associated with the support tabs 12, are also plated with metal and are used to connect the top metal layer 27 to circular metal regions 30 on the bottom side of the ground plane 24. The feed tab 10 and support tabs 12 also include a flange 18, which aligns with the feed hole 20 and support holes 22. The circular metal regions 30 allow the antenna 9 to be soldered to the ground plane 24 at the feed tab 10 and support tabs 12. The solder may be applied from a back side of the ground plane 24.

In an exemplary embodiment, the antenna 9 measures 40 mm by 40 mm between opposite edges. At each corner, a triangular region measuring 8 mm by 8 mm is removed. The feed tab 10 and support tabs 12 are 2 mm wide. The flange 18 measures 1 mm by 1 mm. The feed tab 10 and support tabs 12 are 7 mm long and are separated from the surrounding metal plate 16 by 0.5 mm. The antenna 9 is made of tin plated brass that is 0.75 mm thick. The antenna 9 is tuned to the Personal Communications Services (PCS) band at approximately 1.9 GHz, although the antenna may be tuned to other frequencies.

Figure 7:
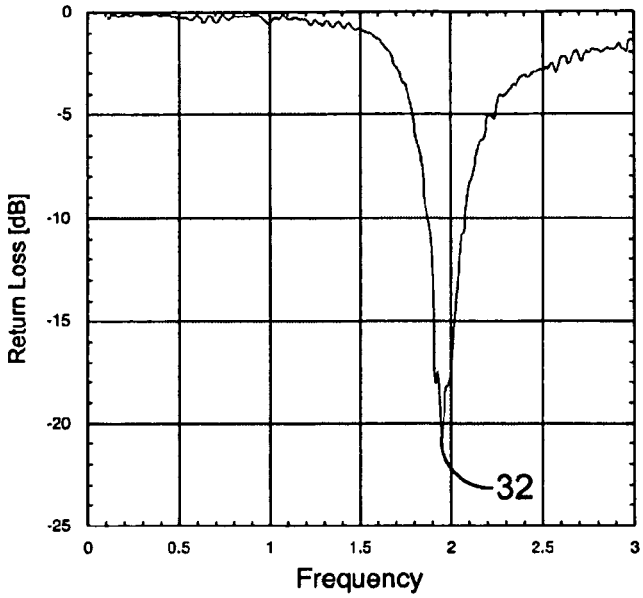
FIG. 7 is a graph showing return loss of the antenna as a function of frequency.
Figure 8:
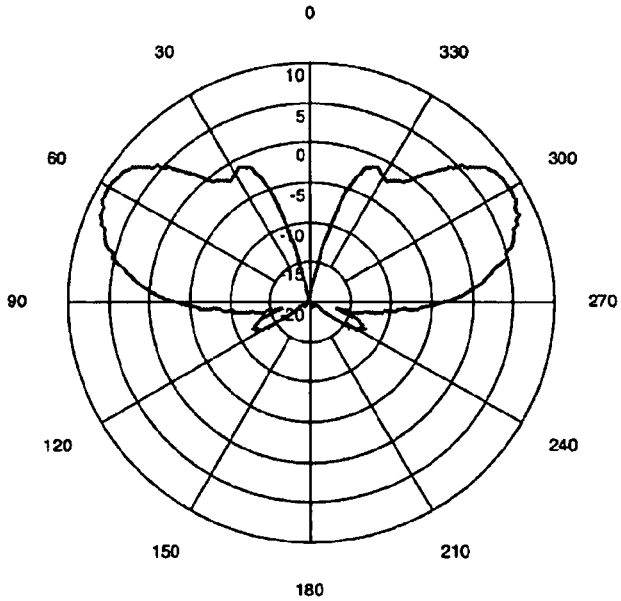
FIG. 8 is a plot illustrating the average elevation gain of the antenna.

Referring now to FIG. 7, return loss for the antenna 9 is shown as a function of frequency. A sharp dip identified at 32, which occurs at 1.9 GHz, indicates that the antenna is well-matched at 1.9 GHz. FIG. 8 shows the average elevation gain of the antenna 9 when mounted on a 1 m ground plane. The gain is greatest for angles below 45 degrees. The radiation pattern typically varies by no more than one or two dB in the azimuth direction. Due to the symmetry of the antenna, the radiation pattern is substantially null towards zenith. Typically, power toward the zenith is at least 10 dB less than the average power in the azimuth direction. This is ideal for mounting on a metal roof of a vehicle and communicating with a terrestrial wireless system. However, the antenna is not restricted to these parameters.

The support tabs 12 are used to achieve an acceptable impedance match to a standard 50 ohm transmission line. The geometry and height of the metal plate 16 and the location of the support tabs 12 can be determined from several equations that will be outlined below. The metal plate 16 of the antenna 9 can be formed of a single piece of metal to reduce cost. Alternatively, the feed tab 10 and support tabs 12 can be formed from a different piece of metal and attached to the metal plate 16 at a desired angle.

Figure 9:
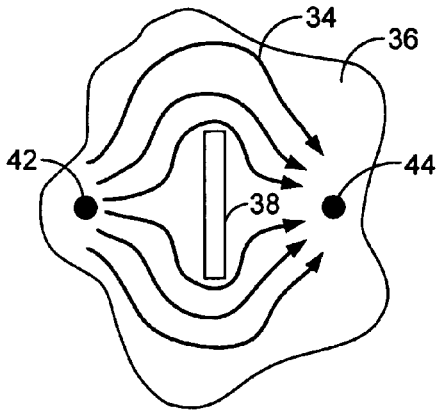
FIG. 9 illustrates a first path that current travels with a slot formed perpendicular to the flow of the current.
Figure 10:
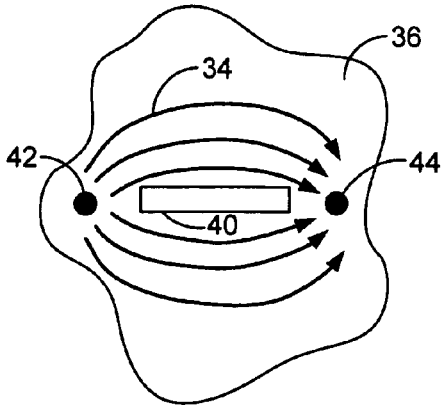
FIG. 10 illustrates a second path that current travels with a slot formed parallel to the flow of current.

FIGS. 9 and 10 illustrate current flow 34 on a piece of metal 36 containing a perpendicular slot 38 and a parallel slot 40 respectively. Current flow 34 travels from a source 42 to a sink 44. The current flow 34 travels around the perpendicular slot 38 and the parallel slot 40. The path of the current flow 34 is significantly altered by the perpendicular slot 38, which causes radiation. It is difficult to determine antenna properties from simple design equations because the presence of the perpendicular slot 38 must be taken into account. If a parallel slot 40 is used, it will have very little effect on the properties of the antenna.

Figure 11:
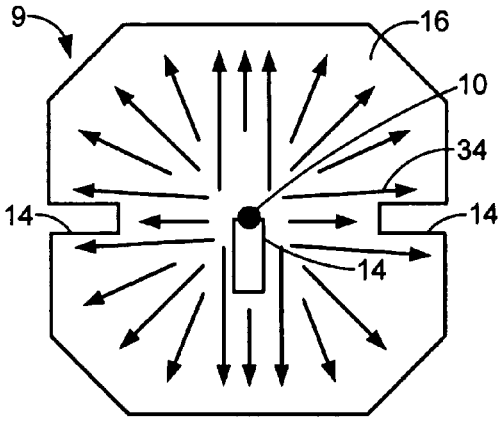
FIG. 11 illustrates a third path of current in the metal plate according to the present invention.

Referring now to FIG. 11, the current path 34 of the antenna 9 is shown. The current path 34 travels from the feed tab 10 toward the periphery of the antenna, and also toward the support tabs 12. The slots 14 extend radially from the center of the antenna 9 and, therefore, cause minor disruption to current flow 34.

Figure 12:
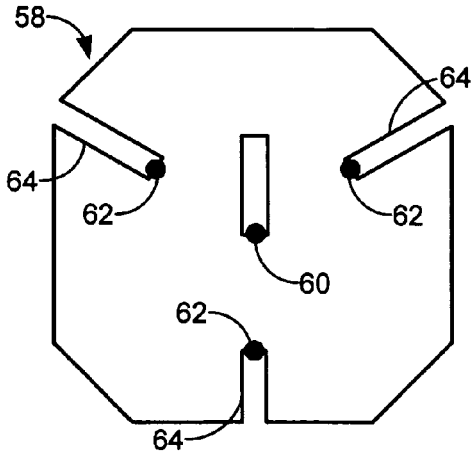
FIG. 12 illustrates an exemplary placement of tabs for a metal plate containing four tabs.

In FIG. 12, an antenna 58 is shown with a feed tab 60 and three support tabs 62. The support tabs 62 are located symmetrically about the feed tab 60. The antenna 58 has at least threefold rotational symmetry. The slots 64 are oriented radially with respect to the center of the antenna 58.

It is assumed that the antenna 9 behaves as an LC circuit. The resonance frequency of the LC circuit is $$\omega = \frac{1}{\sqrt{LC}},$$

where L is the inductance, C is the capacitance, and $\omega=2\pi f$ is the angular frequency. The antenna 9 is to be matched to a transmission line of impedance Z. A typical value for Z is 50 ohms, although other impedances can be used. Setting the intrinsic impedance of the antenna to the impedance of the transmission line, where $$Z = \sqrt{\frac{L}{C}},$$

the required capacitance is equal to $$C = \frac{1}{\omega Z},$$

and the required inductance is equal to $$L = \frac{Z}{\omega}.$$

The geometry is further constrained by the need to fill a certain volume to achieve a required bandwidth. The usual formula for the bandwidth is $$B \le \frac{V}{V_r}, \text{ where } V_r = \frac{4\pi}{3}\left(\frac{\lambda}{2\pi}\right)^3,$$

which is a function of the wavelength $\lambda$. To satisfy the above inequality, the bandwidth is assumed to be a factor of 2 worse than the best case. This gives a required volume of $$V = \frac{\lambda^3 B}{3\pi^2}.$$

A first formula for the capacitance of a region having an area A and a height d that is filled with a dielectric material $\in=\in_0\in_r$ (which is $$\left(\text{which is } C = \frac{\varepsilon A}{d}\right)$$

is used. A second formula for the volume of the capacitor, which is V=Ad is also used. Based on these formulas, $$A = \left(\frac{\lambda}{2\pi}\right)^2 \sqrt{\frac{8\pi B}{3cZ\varepsilon}} \text{ and } d = \left(\frac{\lambda}{2\pi}\right)\sqrt{\frac{8\pi cZ\varepsilon B}{3}},$$

where c is the speed of light.

Assuming that Z=50 ohms, these equations can be simplified to the following:

$$A \approx 8\sqrt{\frac{B}{\varepsilon_r}}\left(\frac{\lambda}{2\pi}\right)^2 \text{ and } d \approx \sqrt{B\varepsilon_r}\left(\frac{\lambda}{2\pi}\right).$$

In a first step in designing an antenna according to these rules, a metal plate having the area A is fabricated, stamped, or otherwise formed. Tabs are cut into the plate having length d. The tabs suspend the plate above the ground plane by the distance d. In a second step, the positions of the tabs are determined. One feed tab is located in the center. The support tabs are located a distance R from the center. R is determined by the necessary inductance, which was calculated previously. An approximation, $$L = d\frac{\mu}{2\pi}\ln\left(\frac{R}{r}\right),$$

for the inductance of a coaxial cable having a length d, an inner radius r, and an outer radius R can be used. This equation provides a good starting point. Fine-tuning the antenna through trial and error, or through simulations, can be used for improved performance.

Using the equation gives $$R = r\cdot\exp\left(\frac{Z}{f\mu d}\right),$$

where R indicates the position of the support tabs from the feed tab and r indicates the radius of the tabs. This equation assumes that the tabs are cylindrical in shape. Because the tabs are not cylindrical, this formula is an approximation. A value of half the width of the tabs is typically a good approximation for r.

The position of the support tabs from the center tab, R, can be determined from the equation. If the previous equation produces a value for R that is greater than the distance from the center of the metal plate to the edges, fewer support tabs should be used. If necessary, one support tab can be used and should start near the edge of the plate. An unstable structure with difficult mechanical tolerances would result if the equation produced a value that is close to the size of the tabs. In this case a greater number of support tabs should be used, and they should start near the midpoint of the plate. Generally, two support tabs are sufficient.

Those skilled in the art can now appreciate from the foregoing description that the broad teachings of the present invention can be implemented in a variety of forms. Therefore, while this invention has been described in connection with particular examples thereof, the true scope of the invention should not be so limited since other modifications will become apparent to the skilled practitioner upon a study of the drawings, specification, and the following claims.

The invention claimed is:

1. A low-profile antenna, comprising:

a metal plate;

a feed tab that is formed in said metal plate near a center point of said metal plate and that has a folded state and an unfolded state; and a ground plane, wherein when said feed tab is in the unfolded state the feed tab is located entirely within an outer perimeter of said metal plate, and wherein when said feed tab is in the folded state, said feed tab creates a first slot in said metal plate and contacts said ground plane, a first end of said first slot is located near the center point and a second end of said first slot is located within the outer perimeter.

2. The low-profile antenna of claim 1 wherein said metal plate has mirror symmetry in at least four planes that intersect at said center point before said feed tab is formed in said metal plate.

3. The low-profile antenna of claim 1 further comprising:

a first support tab that is formed in said metal plate and contacts said ground plane, wherein said first support tab is folded and creates a second slot in said metal plate.

4. The low-profile antenna of claim 3 further comprising:

a second support tab that is formed in said metal plate and contacts said ground plane, wherein said second support tab is folded and creates a third slot in said metal plate.

5. The low-profile antenna of claim 4 wherein said metal plate has mirror symmetry in at least two planes that intersect at said center point when said first and second support tabs are formed in said metal plate and before said feed tab is formed in said metal plate.

6. The low-profile antenna of claim 4 wherein said first and second support tabs are oriented radially with respect to said center point.

7. The low-profile antenna of claim 4 wherein said first and second support tabs are located symmetrically with respect to said center point.

8. The low-profile antenna of claim 4 wherein said feed tab, said first support tab, and said second support tab include a flange for aligning said metal plate with said ground plane.

9. The low-profile antenna of claim 4 wherein said first and second support tabs perform impedance matching.

10. The low-profile antenna of claim 1 wherein said ground plane is a printed circuit board, comprising:

a top metal layer;

a bottom metal layer;

a dielectric material layer between said top metal layer and said bottom metal layer;

a feed hole through said printed circuit board that aligns with said center point of said metal plate;

a circular insulating region formed in said top metal layer that surrounds said feed hole, wherein said circular insulating region leaves an isolated metal region of said top metal layer within said circular insulating region; and a first metal via that is plated inside said feed hole and connects said isolated metal region to a feed circuit on a bottom side of said printed circuit board.

11. The low-profile antenna of claim 10 further comprising:

a first support hole through said printed circuit board;

a second metal via that is plated inside said first support hole; and a first circular metal region surrounding said first support hole on said bottom side.

12. The low-profile antenna of claim 11 further comprising:

a second support hole through said printed circuit board;

a third metal via that is plated inside said second support hole; and a second circular metal region surrounding said second support hole on said bottom side.

13. The low-profile antenna of claim 1 wherein said low-profile antenna is mounted vertically on the exterior of a vehicle.

14. The low-profile antenna of claim 1 wherein said low-profile antenna is part of a multi-antenna module.

15. The low-profile antenna of claim 1 wherein said low-profile antenna produces a radiation pattern that is substantially omnidirectional in the azimuth and substantially null toward zenith.

16. The low-profile antenna of claim 1 wherein said metal plate includes tin plated brass.

17. The low-profile antenna of claim 1 wherein said low-profile antenna operates in the Personal Communications Services (PCS) frequency band.

18. A method for producing a low-profile antenna, comprising:

forming a feed tab in an unfolded state near a center point of a metal plate and located entirely within an outer perimeter of said metal plate;

folding said feed tab into a folded state to create a first slot in said metal plate, wherein a first end of said first slot is located near the center point and a second end of said first slot is located entirely within the outer perimeter;

providing a ground plane; and contacting said feed tab and said ground plane.

19. The method of claim 18 wherein said metal plate has mirror symmetry in at least four planes that intersect at said center point before said feed tab is formed in said metal plate.

20. The method of claim 18 further comprising:

forming a first support tab in said metal plate;

folding said first support tab to create a second slot in said metal plate; and contacting said first support tab and said ground plane.

21. The method of claim 20 further comprising:

forming a second support tab in said metal plate;

folding said second support tab to create a third slot in said metal plate; and contacting said second support tab and said ground plane.

22. The method of claim 21 wherein said metal plate has mirror symmetry in at least two planes that intersect at said center point when said first and second support tabs are formed in said metal plate and before said feed tab is formed in said metal plate.

23. The method of claim 21 wherein said first and second support tabs are oriented radially with respect to said center point.

24. The method of claim 21 wherein said first and second support tabs are located symmetrically with respect to said center point.

25. The method of claim 21 further comprising forming a flange in said feed tab, said first support tab, and said second support tab for aligning said metal plate with said ground plane.

26. The method of claim 21 wherein said first and second support tabs perform impedance matching.

27. The method of claim 18 wherein said ground plane is a printed circuit board, and further comprising:

providing said printed circuit board with a top metal layer, a bottom metal layer, and a dielectric material layer between said top metal layer and said bottom metal layer;

forming a feed hole through said printed circuit board that aligns with said center point of said metal plate;

forming a circular insulating region in said top metal layer that surrounds said feed hole, wherein said circular insulating region leaves an isolated metal region of said top metal layer within said circular insulating region;

providing a feed circuit on a bottom side of said printed circuit board; and plating a first metal via inside said feed hole that connects said isolated metal region to said feed circuit.

28. The method of claim 27 further comprising:

forming a first support hole through said printed circuit board;

plating a second metal via inside said first support hole; and forming a first circular metal region surrounding said first support hole on said bottom side.

29. The method of claim 28 further comprising:

forming a second support hole through said printed circuit board;

plating a third metal via inside said second support hole; and forming a second circular metal region surrounding said second support hole on said bottom side.

30. The method of claim 18 wherein said low-profile antenna is mounted vertically on the exterior of a vehicle.

31. The method of claim 18 wherein said low-profile antenna is part of a multi-antenna module.

32. The method of claim 18 wherein said low-profile antenna produces a radiation pattern that is substantially omnidirectional in the azimuth and substantially null toward zenith.

33. The method of claim 18 wherein said metal plate includes tin plated brass.

34. The method of claim 18 wherein said low-profile antenna operates in the Personal Communications Services (PCS) frequency band.

* * * * *